United States Patent [19]

Anderwald

[11] 4,168,017

[45] Sep. 18, 1979

[54] CONTAINER MEANS PREVENTING ACCIDENTAL USE BY CHILDREN

[76] Inventor: Cecil E. Anderwald, 3077 Windmill La., Dallas, Tex. 75234

[21] Appl. No.: 784,684

[22] Filed: Apr. 5, 1977

[51] Int. Cl.[2] ..... B67D 5/22

[52] U.S. Cl. ..... 222/48; 222/153; 222/555

[58] Field of Search ..... 220/253, 336; 222/153, 222/23, 41, 48, 548, 553, 555; 221/4, 154

[56] References Cited

U.S. PATENT DOCUMENTS

| | | | |
|---|---|---|---|
| 2,027,503 | 1/1936 | Whitehead | 222/153 |
| 2,961,228 | 11/1960 | Moore | 220/253 |
| 3,313,441 | 4/1967 | Fadden | 222/48 |
| 3,893,593 | 7/1975 | Hazard | 222/48 |

*Primary Examiner*—Robert J. Spar
*Assistant Examiner*—H. Grant Skaggs
*Attorney, Agent, or Firm*—Howard I. Podell

[57] ABSTRACT

A vertical hollow container has a top opening. First and second vertically spaced horizontal plates are disposed in sealing engagement in the container opening. The plates have aligned central holes. A vertical hollow pouring shaft is secured at its bottom open end to the aligned holes and extends upwards from the upper plate. First and second overlapping horizontal rotatable discs are disposed between the plates. Each disc is separately and individually rotatable about a corresponding axis. The discs each have off center holes which can be individually aligned with each other and with the aligned holes in the plates.

2 Claims, 1 Drawing Figure

FIG. 1
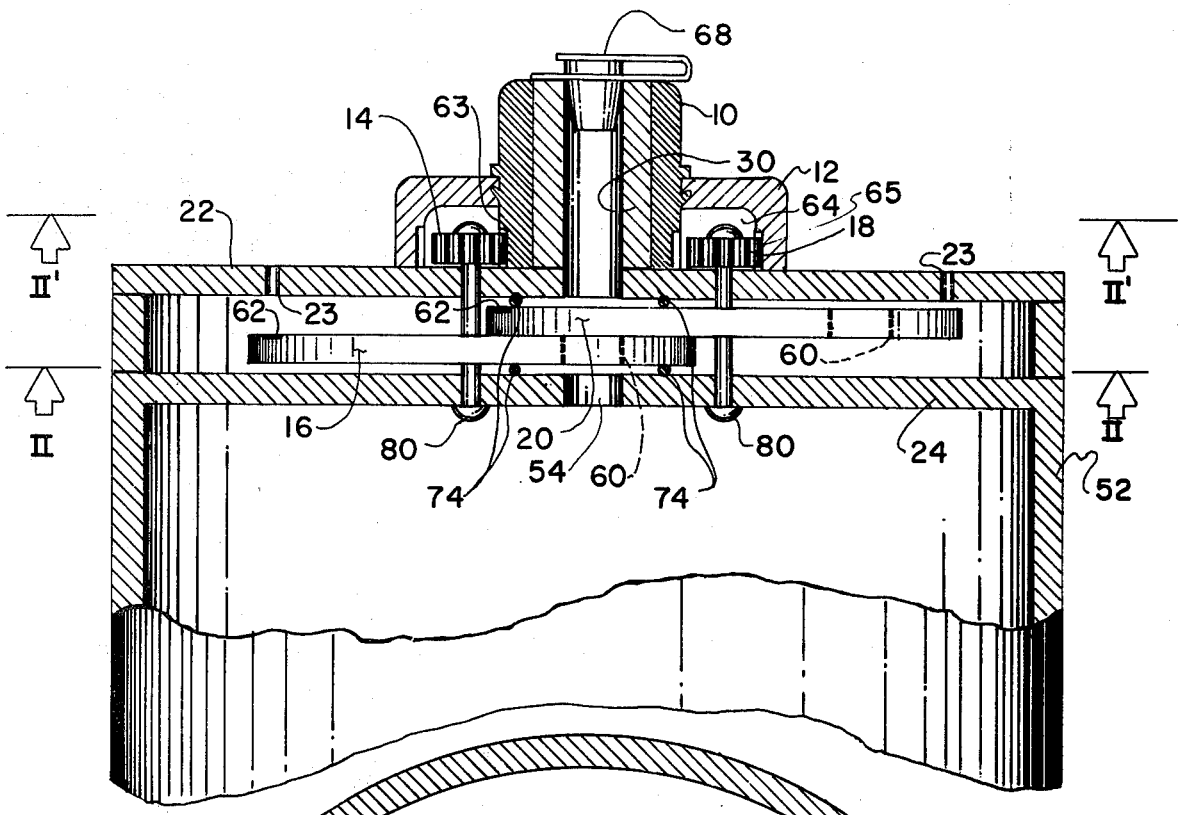
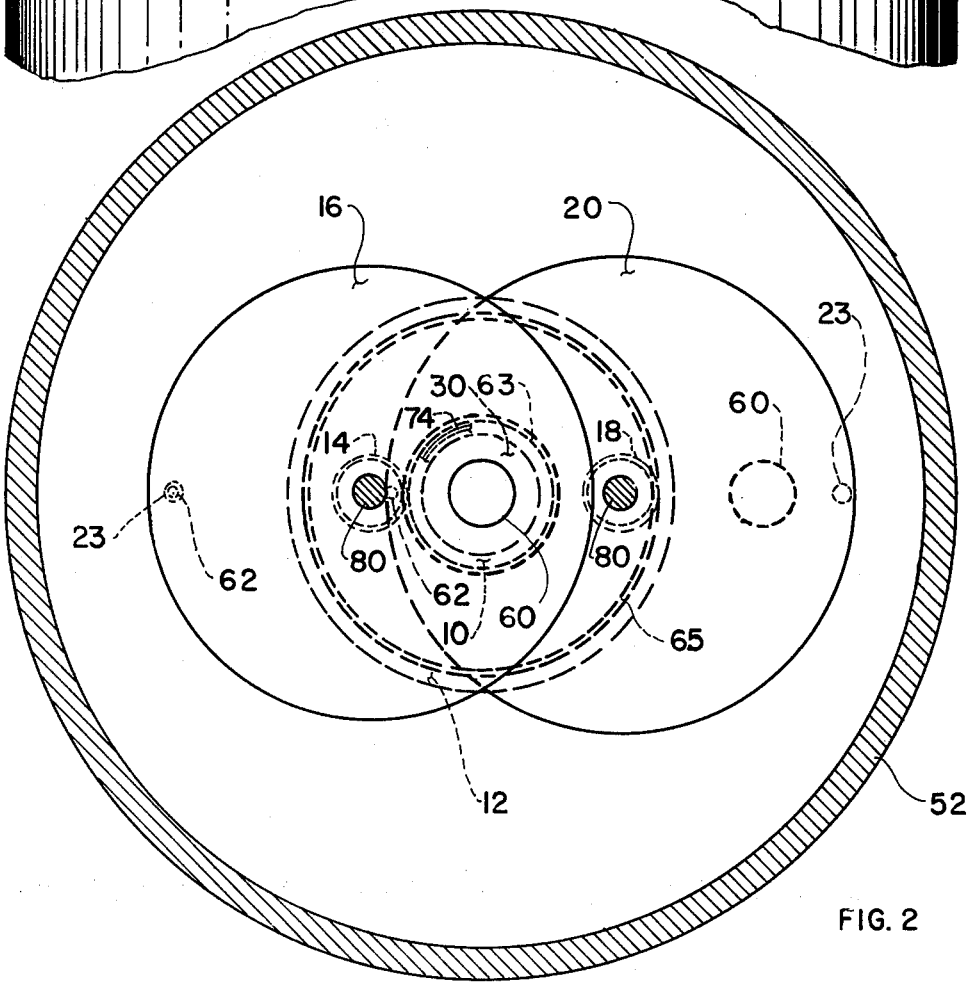
FIG. 2

CONTAINER MEANS PREVENTING ACCIDENTAL USE BY CHILDREN

SUMMARY OF THE INVENTION

My invention is directed toward a device which will enable an adult to pour liquid as for example medicine out of a container while at the same time being so designed that a child will be unable to do so.

In accordance with my invention, a container of such liquid disposed vertically with a top opening contains upper and lower horizontal spaced plates having aligned central holes sealed in the container opening. A vertical hollow pouring spout shaft open at both ends is secured at its bottom end to the upper plate and extends upwards.

First and second overlapping horizontal discs rotatable about corresponding vertical axes each have off center holes alignable with the central holes of the plates and the bottom end of the shaft. The discs are disposed between the plates.

First and second manually operable means separately and individually rotate corresponding first and second discs respectively to align the disc and plate holes whereby then and only then liquid can be poured out of the container.

BRIEF DESCRIPTION OF THE DRAWINGS

In the drawings:

FIG. 1 is a detail elevation sectional view of my device; and

FIG. 2 is a horizontal cross sectional view thereof, taken upwards along line II—II of the section between line II—II and II'—II'.

DETAILED DESCRIPTION OF PREFERRED EMBODIMENTS

As shown in FIGS. 1 and 2, a hollow container 52 has a top center opening 54 into which flat horizontal spacer 56 is disposed. A vertical hollow pouring shaft 30 is secured to the top of the unit and extends upward. A flap type cap 68 can detachably seal the top opening of shaft 30. Hollow small knob 10 and large knob 12 disposed one above the other are individually manually rotatable about shaft 30.

Upper and lower horizontal circular plates 22 and 24 have circular openings aligned with the small central opening and are sealed thereto by O rings 74. First and second overlapping horizontal discs 16 and 20 are disposed between plates 22 and 24. Each disc has an offset hole 60 alignable with shaft 30 and an oppositely disposed red dot 62.

Knobs 10 and 12 have peripheral teeth which respectively engage cog gears 14 and 18. These gears are respectively secured to individual vertical shafts 80 extending through and secured to the centers of discs 16 and 20 respectively whereby rotation of knob 10 causes gear 14 and disc 16 to rotate and rotation of knob 12 causes gear 18 and disc 20 to rotate. The gear teeth 63 of knob 10 are disposed on the outside of its periphery. Knob 12 has a recess 64 with the gear teeth 65 disposed on the inner periphery. Hence gear 14 is disposed outside of knob 10 while gear 18 is disposed inside recess 64.

When the knobs are rotated so that the red dots on the discs are aligned with apertures 23 of plate 22, then liquid in the container can be poured out through the shaft, aligned holes and openings. When the red dots are not aligned, the pouring path will be blocked.

While the invention has been described by means of specific examples and in specific embodiments, I do not wish to be limited thereto, for obvious modifications will occur to those skilled in the art without departing from the spirit and scope of the invention.

Having thus described this invention, what is asserted as new is:

1. In combination with a vertical hollow container having a top opening;

first and second vertically spaced horizontal plates disposed in sealing engagement in the top section of the container, the plates having aligned central holes;

a vertical hollow pouring shaft secured to an uppermost said plate and extending upwards from the said uppermost plate with the hollow core of said shaft aligned with said central holes, first and second overlapping horizontal discs, each rotatable 360° about a corresponding vertical axis, each disc having an off-center hole alignable with the central holes of the plates and the hollow interior of the shaft, said discs being disposed between said plates; and first and second manually operable means for separately and individually rotating corresponding first and second discs respectively to align the disc holes and plate holes so as to allow liquid to be poured out of the container, wherein each disc has a spot oppositely disposed from its off-center hole and alignable with an aperture in the upper plate when said off-center hole is aligned with the center hole of the plates, and wherein each said first and second manually operable means includes a vertical shaft secured to the center of the corresponding disc and extending upward, a gear fixed to the vertical shaft, and a rotatable knob linked in rotational engagement with said gear, so that each knob is in rotational engagement with a corresponding disc.

2. The combination as recited in claim 1 in which the said knobs are mounted together in concentric fashion with respect to each other so that each knob is independently rotatable with respect to the other knob, with both knobs rotatably and concentrically mounted about the pouring shaft.

* * * * *